United States Patent [19]

Haberkorn et al.

[11] 3,998,397

[45] Dec. 21, 1976

[54] COIL TRANSPORTING DEVICE

[75] Inventors: Egon Haberkorn; Siegfried Demandt, both of Rheydt, Germany

[73] Assignee: W. Schlafhorst & Co., Monchen-Gladbach, Germany

[22] Filed: Oct. 21, 1974

[21] Appl. No.: 516,602

[30] Foreign Application Priority Data

Oct. 22, 1973 Japan ..... 48.118863

[52] U.S. Cl. ..... 242/35.5 A

[51] Int. Cl.[2] ..... B65H 67/06; B65H 54/22

[58] Field of Search ..... 242/35.5 A, 35.5 R, 242/35.6 R; 198/32, 40, 85, 187, 185, 287, 288

[56] References Cited

UNITED STATES PATENTS

| | | | |
|---|---|---|---|
| 2,350,927 | 6/1944 | Reiners et al. | 242/35.5 A |
| 3,111,280 | 11/1963 | Reiners et al. | 242/35.5 R |
| 3,447,707 | 6/1969 | Furst | 242/35.5 R X |
| 3,618,306 | 11/1971 | Fenstermacher | 242/35.5 R X |
| 3,650,373 | 3/1972 | Kern et al. | 198/85 |
| 3,774,859 | 11/1973 | Brouwer et al. | 242/35.5 R |

*Primary Examiner*—Stanley N. Gilreath
*Attorney, Agent, or Firm*—Herbert L. Lerner

[57] ABSTRACT

Device for feeding cops to winding stations of a winding machine includes an endles conveyor belt traveling in axial direction past the winding stations and feeding thereto, as needed, cops carried by a forward traveling upper run of the conveyor belt, the endless conveyor belt having a reversing location beyond the last winding station of the machine, a first reversing device located between the last winding station and the reversing location of the conveyor belt, the first reversing device having means for removing from the forward traveling upper run of the endless conveyor belt cops which had not been fed to the winding stations and for depositing the cops on a returning lower run of the endless conveyor belt, and a second reversing device in vicinity of the returning lower run, the second reversing device having means for removing the cops from the returning lower run, and for transfering the cops to the forward traveling upper run of the endless conveyor belt.

6 Claims, 7 Drawing Figures

COIL TRANSPORTING DEVICE

The invention relates to a coil transporting or conveying device and, more particularly, to a device for feeding supply coils or cops to winding stations of a winding machine wherein an endless conveyor belt travels in axial direction thereof past the winding stations and feeds thereto, as needed, cops carried by the endless conveyor belt.

Winding machines are frequently furnished with a magazine for receiving therein coils or cops that are to be processed. The cops can be drawn from the magazine for processing. Heretofore, the magazine was filled with the cops by servicing or operating personnel. It is desired, however, that this operation be automated. Accordingly, devices have been provided heretofore by which the cops are fed by a conveyor belt. Therewith, a magazine is coordinated with each winding station and can receive a cop. If this cop is drawn into the unwinding location, then a new cop is made ready in the magazine. Such heretofore known conveyor devices are formed of a conveyor belt which carries a number of conveyor pockets wherein the cops are received, respectively. The attachment of such previously known devices requires great alterations in the winding machines.

Coil conveying devices have also become known heretofore wherein the filling of the magazine is effected by means of a conveyor belt provided with pockets. In order to avoid too great a hindrance or obstruction to the accessibility to the winding stations, the conveyor belt must be placed so high that it is located above the level of the eyes of the personnel servicing the winding machine. The coils are allowed to fall into a pocket of the magazine through tubular channels. These channels, however, have the disadvantage that they obstruct accessibility to the individual winding stations. Moreover, costly devices are required to brake the fall of the coils.

Other conveyor devices with movable switches have also become known heretofore, which divert the cop at a winding station whereby the cop is advanced from the upper side of a conveyor belt to the underside thereof. In further developments of these known devices, wherein continuous cop transfer from one conveyor belt to another is effected with the aid of mechanical switches, the conveyor belts have been shifted so as to be substantially perpendicular to one another and disposed in one plane.

It is an object of the invention of the instant application to provide a coil or cop transporting or conveying device which takes up such a small amount of space that they can be mounted in front of the existing cop storing magazine without materially impairing the accessibility of the winding stations to the servicing personnel.

With the foregoing and other objects in view, there has been provided, in accordance with the invention, a device for feeding cops to winding stations of a winding machine comprising an endless conveyor belt traveling in axial direction past the winding stations and feeding thereto, as needed, cops carried by a forward traveling upper run of the conveyor belt, the endless conveyor belt having a reversing location beyond the last winding station of the machine, a first reversing device located between the last winding station and the reversing location of the conveyor belt, the first reversing device having means for removing from the forward traveling upper run of the endless conveyor belt cops which had not been fed to the winding stations and for depositing the cops on a returning lower run of the endless conveyor belt, and a second reversing device in vicinity of the returning lower run, the second reversing device having means for removing the cops from the returning lower run and for directly transferring the cops to the forward traveling upper run of the endless conveyor belt or to a feeding device which then feeds the cops to the forward traveling upper run of the endless conveyor belt.

In accordance with another feature of the invention, the first reversing device comprises means for rolling the cops laterally off the upper run of the conveyor belt, and track means adjacent the cop rolling means for rolling the cops onto the returning lower run of the conveyor belt.

In accordance with a further feature of the invention, the cop rolling means comprises an auxiliary guide for the endless conveyor belt, the auxiliary guide tending to incline the upper run of the conveyor belt transversely to the axial travel direction thereof.

In accordance with an additional feature of the invention, the second reversing device is located in vicinity of the end of the returning lower run of the endless conveyor belt and comprises means for rolling the cops laterally off the returning lower run of the conveyor belt, and conveying means adjacent the cop rolling means for receiving the cops rolled off the lower run by the cop rolling means.

In accordance with an added feature of the invention, the cop rolling means comprises an auxiliary guide for the endless conveyor belt, the auxiliary guide tending to incline the lower run of the conveyor belt transversely to the axial travel direction thereof.

In accordance with yet another feature of the invention, the second reversing device comprises means for rolling the cops laterally off the returning lower run of the conveyor belt and conveying means adjacent the cop-rolling means for receiving thereon the cops rolled off the lower run by the cop rolling means, the conveying means comprising a further endless conveyor belt traveling in axial direction of the cops that have been rolled thereon laterally from the lower run of the first-mentioned endless conveyor belt.

In accordance with a concomitant feature of the invention, there are provided means for switching off the feed of a cop to a respective winding station when a cop returning on the lower run of the endless conveyor belt is removed by the second reversing device from the lower run and transferred to the forward traveling upper run of the conveyor belt.

The cop conveying device can comprise a conventional conveyor belt by which the cops are advanced in axial direction. Such a conveyor belt is required only to have a width that is somewhat greater than the greatest diameter of cops that are to be processed. From this conveyor belt, the cops, as needed or upon demand, are conducted into a storage magazine by means of a switch.

In order that all of the magazines supplied by the conveyor belt will receive an adequate number of cops, the conveying capacity of the belt must be somewhat higher than the actual requirement of all the winding stations. It can therefore not be avoided that, at the end of the conveyor belt, excess cops will appear which must be fed back. The returning lower run of the endless conveyor belt serves this purpose. The oncoming cops that are located on the outer side of the upper run of the conveyor belt are so diverted that the return thereof on the inner side of the lower run of the conveyor belt can be effected.

In the vicinity of the side of the conveyor belt from which the cops are fed thereto by a feeding device, the cops which have been fed back are guided to another reversing device which returns the cops directly to the upper run of the conveyor belt or returns them to the feeding device which feeds the cops thereto. This other reversing device preferably comprises a further relatively short conveyor belt. In this manner, only a single conveyor belt is required for conveying the cops back and forth. If the other reversing device somewhat widens the conveyor device, it can be disposed in a region wherein the accessibility to the winding stations is not obstructed.

The cops are preferably deposited by the feeding device on the conveyor belt at equal spacing one from the other. In this regard, the spacing between the cops is selected to be at least so large that there is adequate assurance that simultaneous removal of two cops at a time when the switch is opened will be avoided. In order to assure also that there will be such adequate spacing between the cops, the feeding of the cops to the upper run of the conveyor belt is switched off when a cop that has been returned on the lower run of the conveyor belt is diverted onto the forward traveling upper run of the conveyor belt.

Basically, the cop conveying device of the invention is not limited to the use thereof for filling magazines but rather is suited for all purposes wherein, at one or more locations, there exists a requirement of or demand for cops which must be satisfied within a given time interval.

Although the invention is illustrated and described herein as embodied in coil transporting device, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
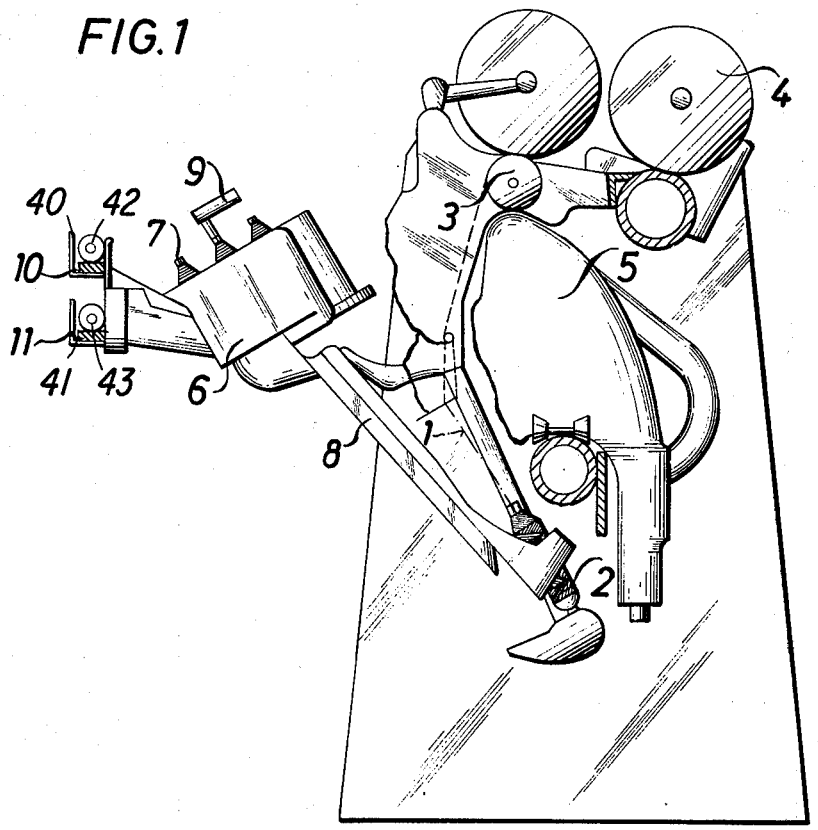
FIG. 1 is a diagrammatic side elevational view, partly in section, of an automatic winding machine having a coil magazine and provided with a coil transporting device according to the invention.

Referring now to the drawing and first, particularly to FIG. 1 thereof, there is shown diagrammatically an automatic winding machine wherein a thread 1 represented by a broken line runs from a supply coil or cop 2 to a thread guiding drum 3 and is wound on a take-up coil 4. Behind the illustrated winding station of the multi-station automatic winding machine shown in FIG. 1, there travels a knotting device 5 of conventional construction which repairs breaks in the thread and delivers unwound and empty coils into unwinding position from which they can be replaced. Reserve supply coils 7 are provided in a conventional magazine 6. Upon demand, the reserve coils 7 are respectively advanced down a slide 8 into the unwinding position. A conventional gripper head 9 is located above the magazine 6 and picks up the starting end of the respective reserve coil that has been placed in unwinding position. The knotting device 5 thereafter takes over the starting end of the thread. The coil transporting device of the invention is located in front of the magazine 6, i.e. to the left-hand side thereof as viewed in FIG. 1, and includes an endless conveyor having an upper run 10 running into the plane of FIG. 1 and a lower run 11 running out of the plane of FIG. 1.

The upper run 10 of the conveyor is disposed in a U-shaped channel 40 and the lower return run 11 in a U-shaped channel 41. Shown on the upper run 10 is coil 42 which is being transported and on the lower run 11, coil 43 is shown which is being transported back.

Figure 2:
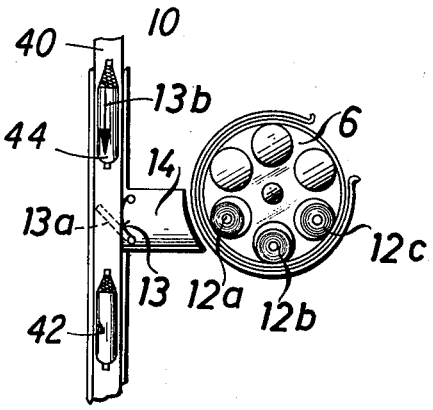
FIG. 2 is a top plan view of the coil magazine of FIG. 1 and showing a coil transport belt and switch according to the invention.

FIG. 2 shows the magazine 6 provided with magazine pockets of which the pockets 12*a*, 12*b* and 12*c* are shown filled with respective reserve coils or cops 7. If the magazine 6 is advanced one step because a coil is required in the unwinding position, an empty pocket is located at the position 12*a*. By the advancement of the magazine 6, a signal is released which causes the switch 13 to swing into a position 13*a* shown by a broken line. If a coil approaches the switch 13*a* in direction of the arrow 13*b*, the coil is diverted from the belt run 10 and slides down the slide 14 into the empty magazine pocket. By means of another signal transmitter, the switch 13 is again set back to its original position. On the upper run 10, one can see coils 42 and 44 which are being transported.

Figure 3:
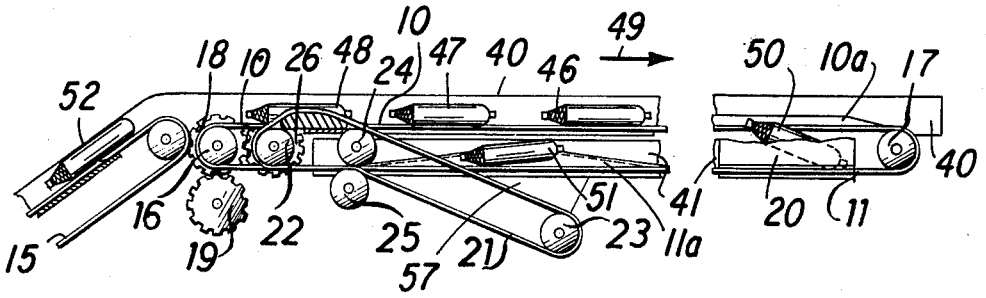
FIG. 3 is a diagrammatic front elevational view, partly broken away, of the coil transporting device provided with reversing mechanisms.
Figure 4:
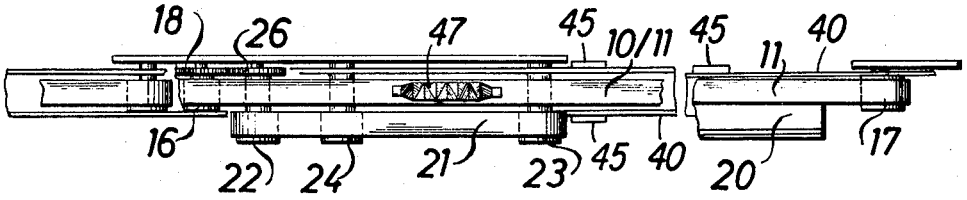
FIG. 4 is top plan view of FIG. 3.

In FIGS. 3 and 4, the front and rear parts of the coil transporting device with reversing mechanism of the invention are mainly shown. These parts are located in a region wherein no magazines are found, that is, at the beginning and end of a coil winding machine. As can be readily seen in FIGS. 3 and 4, that part which runs past the magazines, is formed only of a forward-traveling and return-traveling endless portion and the U-shaped channels 40 and 41 which are connected by side plates 45.

A coil feed belt 15 is driven by non-illustrated conventional drive system so that coils are respectively delivered thereby to the upper run 10 of the endless conveyor belt after equal intervals of time. The endless conveyor belt formed of the upper run 10 and the lower run 11 is guided around a drive roller 16 and a reversing roller 17. A gear 18 is connected to the drive roller 16 and is continually driven by a drive gear 19 meshing therewith. In the vicinity of the reversing roller 17, a reversing device 20 is disposed, by means of which excess coils from the outer surface of the forward traveling upper run 10 of the endless conveyor belt are conducted to the inner surface of the returning lower run 11 thereof.

Figure 5:
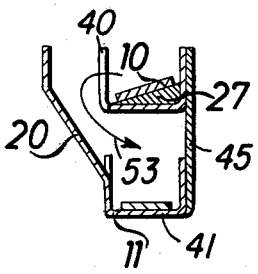
FIG. 5 is a cross-sectional view of the reversing mechanism at the end of the belt, the upper run thereof being shown running away from the viewer perpendicularly to and into the plane of the figure.

As can be seen in the sectional view of FIG. 5, the reversing device 20 includes an inclined guiding wall and a wedge-shaped guide 27 which is disposed beneath the run 10 and which forms a transverse inclination of the latter so that a coil disposed thereon rolls laterally therefrom and is guided onto the lower run 11.

As can be seen especially well in FIG. 4, a relatively short high-running belt 21 revolves in the vicinity of the coil feed location near the endless conveyor belt 10, 11. The high-running belt 21 is guided around a drive roller 22 and a reversing roller 23, and is deflected by guide rollers 24 and 25 so that a part or length thereof travels at the same level so that of the upper run 10. The drive roller 22 is connected to a gear 26 which meshes with the gear 18. Accordingly, the upper run of the high-running belt 21 travels in opposite direction to the travel direction of the upper run 10 of the endless conveyor belt 10, 11.

In the vicinity of the high-running belt 21, another wedge-shaped guide member 56 is mounted under the lower run 11 so that at that location, the coils on the lower run 11 can roll off onto the belt 21. A returning coil can thereby be advanced back again to the outer surface of the upper run 10. The high-running belt 21 is set at a transverse incline between the drive roller 22 and the guide roller 24 by means of a wedge member 28, as shown in FIG. 6, so that the coil again rolls onto the upper run 10 and makes a new travel circuit.

Furthermore, in FIG. 3 are shown the bottom and backside of the U-shaped channels 40 and 41. The front walls were omitted for clarification. The coils 46, 47, 48 are being transported on the upper belt run 10 in the direction of the arrow 49. The coil 50 is being deposited onto the lower run 11 by the slanted lifting member 10*a*, while coil 51 is being deposited onto the run-up belt 21, by slanted lifting member 11*a* or run 11. A guide wall 57 prevents coil 51 from falling off sideways. Coil 52 is being transported on the loading belt 15.

In FIG. 4, all the coils are omitted for clarification except coil 47. FIG. 4 which shows that the U-shaped channel 40 is open to the side in the areas of the reversing device 20 and the run-up belt 21.

According to FIG. 5, the transfer of coils in the reversing device 20 from upper run 10 to lower run 11 is effected in the direction of arrow 53. The U-shaped channels 40 and 41 are open at the point of transfer.

Figure 6:
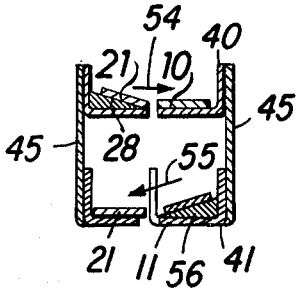
FIG. 6 is a cross-sectional view of the reversing mechanism at the beginning of the belt, the upper run thereof also being shown running away from the viewer into the plane of the figure.

According to FIG. 6, the transfer of coils from run-up belt 21 onto the upper run 10 is effected in the direction of arrow 54, where the belts are near to each other. The U-shaped channels 40 and 41 are also open in this case.

According to FIG. 6, the lower run 11 of the coil transporting device is at the height of the run-up belt 21 positioned at a slant by means of wedge 56 so that the transfer of a coil from belt run 11 to belt 21 can take place in the direction of arrow 55.

Figure 7:
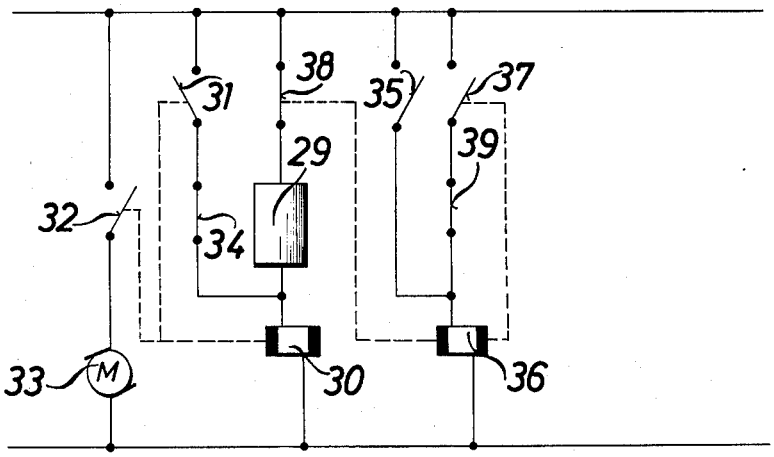
FIG. 7 is an electrical circuit diagram for controlling the feeding of coils by the coil transporting device and devices associated therewith to the winding stations of the coil winding machine.

In FIG. 7 there is shown an electric circuit diagram for appropriately channeling the returning coils, which functions in the following manner:

A timer 29 transmits an electric pulse in a conventional manner at adjustable time intervals. A relay coil 30 is thereby excited and closes a holding contact 31. The relay coil 30 thereby continues to be excited after the pulse of the timer 29 has ended. Once the relay 30 is excited, a contact 32 is closed in a conventional manner and the advancing motor 33 for the coil feeding system 15 (FIG. 3) starts up. The motor 33 continues to operate until a conventional sensor such as an electric eye, for example, determines that a coil has been placed on the end of the upper run 10 by belt 21. A previously closed contact 34 is then opened, discontinuing the supply of current to the relay 30 and thereby opening the contacts 31 and 32. The motor 33 is thereby caused to stop running until a new pulse is issued through the timer 29. The conveyor motor 33 must not be stopped every time when a coil is deposited at the beginning of run 10. The motor has to be stopped only when a coil transfer from the run-up belt 21 takes place, to avoid the possibility that another coil is placed into the same position from loading belt 15.

When a coil is being returned, a contact 5 is closed and a relay coil 36 is electrically energized by a conventional sensor such as an electric eye at the reversing location of the upper run 11 to the conveyor belt 21. A holding contact 37 is thereby closed and the relay coil 36 remains energized even after the coil has been conveyed past the sensor. As long as the relay coil 36 remains energized, a contact 38 stays open so that the timer 29 is currentless. The timer 29 thereby falls back to its initial position and the feeding system delivers no coils. Therefore, the returned coil comes onto the upper run 10 of the conveyor belt 10, 11. The returned coil thereby reaches the vicinity of another sensor which then causes a contact 39 to open so that the relay coil 36 becomes de-energized. The contact 38 is thereby closed, and the timer 29 can start up again. Then, the next coil can be delivered from the feeding belt 15.

We claim:

1. Device for feeding cops to winding stations of a winding machine comprising an endless conveyor belt traveling in axial direction past the winding stations and feeding thereto, as needed, cops carried by a forward traveling upper run of said conveyor belt, said endless conveyor belt having a reversing location beyond the last winding station of the machine, a first reversing device located between the last winding station and the reversing location of said conveyor belt, said first reversing device having means for removing from said forward traveling upper run of said endless conveyor belt cops which had not been fed to the winding stations and for depositing the cops on a returning lower run of said endless conveyor belt, a second reversing device in vicinity of said returning lower run, said second reversing device having conveyor belt means for removing the cops from said returning lower run, and for transferring the cops to said forward traveling upper run of said endless conveyor belt, said first reversing device comprising means for guidingly rolling the cops off said upper run of said conveyor belt and onto said returning lower run of said conveyor belt, said last-mentioned means including an auxiliary guide for said endless conveyor belt, said auxiliary guide being shaped to incline said upper run of said conveyor belt transversely to said axial travel direction thereof.

2. Device for feeding cops to winding stations of a winding machine comprising an endless conveyor belt traveling in axial direction past the winding stations and feeding thereto, as needed, cops carried by a forward traveling upper run of said conveyor belt, said endless conveyor belt having a reversing location beyond the last winding station of the machine, a first reversing device located between the last winding station and the reversing location of said conveyor belt, said first reversing device having means for removing from said forward traveling upper run of said endless conveyor belt cops which had not been fed to the winding stations and for depositing the cops on a returning lower run of said endless conveyor belt, a second reversing device in vicinity of said returning lower run, said second reversing device having conveyor belt means for removing the cops from said returning lower run, and for transferring the cops to said forward traveling upper run of said endless conveyor belt, said first reversing device comprising means for rolling the cops laterally off said upper run of said conveyor belt, and track means adjacent said cop rolling means for rolling the cops onto said returning lower run of said conveyor belt, said cop rolling means comprising an auxiliary guide for said endless conveyor belt, said auxiliary guide being shaped to incline said upper run of said conveyor belt transversely to said axial travel direction thereof.

3. Device for feeding cops according to claim 2 wherein said second reversing device is located in vicinity of the end of said returning lower run of said endless conveyor belt and comprises means for rolling the cops laterally off said returning lower run of said conveyor belt, and conveying means adjacent said cop rolling means for receiving the cops rolled off said lower run by said cop rolling means.

4. Device for feeding cops to winding stations of a winding machine comprising an endless conveyor belt traveling in axial direction past the winding stations and feeding thereto, as needed, cops carried by a forward traveling upper run of said conveyor belt, said endless conveyor belt having a reversing location beyond the last winding station of the machine, a first reversing device located between the last winding station and the reversing location of said conveyor belt, said first reversing device having means for removing from said forward traveling upper run of said endless conveyor belt cops which had not been fed to the winding stations and for depositing the cops on a returning lower run of said endless conveyor belt, a second reversing device in vicinity of said returning lower run, said second reversing device having conveyor belt means for removing the cops from said returning lower run, and for transferring the cops to said forward traveling upper run of said endless conveyor belt, said second reversing device being located in vicinity of the end of said returning lower run of said endless conveyor belt and comprising means for rolling the cops laterally off said returning lower run of said conveyor belt, conveying means adjacent said cop rolling means for receiving the cops rolled off said lower run by said cop rolling means, and said cop rolling means comprising an auxiliary guide for said endless conveyor belt, said auxiliary guide being shaped to incline said lower run of said conveyor belt transversely to said axial travel direction thereof.

5. Device for feeding cops to winding stations of a winding machine comprising an endless conveyor belt traveling in axial direction past the winding stations and feeding thereto, as needed, cops carried by a forward traveling upper run of said conveyor belt, said endless conveyor belt having a reversing location beyond the last winding station of the machine, a first reversing device located between the last winding station and the reversing location of said conveyor belt, said first reversing device having means for removing from said forward traveling upper run of said endless conveyor belt cops which had not been fed to the winding stations and for depositing the cops on a returning lower run of said endless conveyor belt, a second reversing device in vicinity of said returning lower run, said second reversing device having conveyor belt means for removing the cops from said returning lower run, and for transferring the cops to said forward traveling upper run of said endless conveyor belt, said second reversing device comprising means for rolling the cops laterally off said returning lower run of said conveyor belt and conveying means adjacent said cop rolling means for receiving thereon the cops rolled off said lower run by said cop rolling means, said conveying means comprising a further endless conveyor belt traveling in the direction of the cop axes that have been rolled thereon laterally from said lower run of said first-mentioned endless conveyor belt.

6. Device for feeding cops to winding stations of a winding machine comprising an endless conveyor belt traveling in axial direction past the winding stations and feeding thereto, as needed, cops carried by a forward traveling upper run of said conveyor belt, said endless conveyor belt having a reversing location beyond the last winding station of the machine, a first reversing device located between the last winding station and the reversing location of said conveyor belt, said first reversing device having means for removing from said forward traveling upper run of said endless conveyor belt cops which had not been fed to the winding stations and for depositing the cops on a returning lower run of said endless conveyor belt, a second reversing device in vicinity of said returning lower run, said second reversing device having conveyor belt means for removing the cops from said returning lower run, and for transferring the cops to said forward traveling upper run of said endless conveyor belt, and means for switching off the feeding of cops when a cop returning on said lower run of said endless conveyor belt is removed by said second reversing device from said lower run and transferred to said forward traveling upper run of said conveyor belt.

* * * * *